United States Patent [19]

Smith et al.

[11] 4,030,606

[45] June 21, 1977

[54] VIBRATING TUBULAR SCREEN

[75] Inventors: Leward N. Smith, Remus; Larry L. Morey, Mount Pleasant, both of Mich.

[73] Assignee: Morbark Industries, Inc., Winn, Mich.

[22] Filed: Mar. 24, 1976

[21] Appl. No.: 669,997

[52] U.S. Cl. ..... 209/287; 209/365 R; 209/369; 209/406; 259/3

[51] Int. Cl.[2] ..... B07B 1/26

[58] Field of Search ..... 209/287, 293, 301, 397, 209/392, 406, 407, 233, 369, 365 R; 259/DIG. 42, 3

[56] References Cited

UNITED STATES PATENTS

| | | | |
|---|---|---|---|
| 378,785 | 2/1888 | Gilleland | 209/406 X |
| 1,209,861 | 12/1916 | Lennig | 209/287 X |
| 2,027,375 | 1/1936 | Fraser | 209/287 X |
| 2,978,232 | 4/1961 | Kruzan | 259/3 |

FOREIGN PATENTS OR APPLICATIONS

| | | | |
|---|---|---|---|
| 415,605 | 6/1925 | Germany | 209/406 |

*Primary Examiner*—Bernard Nozick
*Assistant Examiner*—Ralph J. Hill
*Attorney, Agent, or Firm*—Learman & McCulloch

[57] ABSTRACT

A vibratory tubular screen for separating particulate material, such as wood chips, into coarse and fine classifications. A hollow tubular screen is mounted for rotation about its axis with the screen axis inclined downwardly away from a receiving hopper through which material is introduced into the interior of the screen. A roller support assembly rotatably supporting the screen intermediate its ends includes a resiliently biased support member which is deflectable downwardly in accordance with the combined weight of the screen and material contained in the screen. When the combined weight of the screen and material exceeds a predetermined weight, the resiliently biased member is deflected downwardly to a position in which a vibrating element comes in contact with the screen to impart a radially directed vibratory action to the screen as it is driven in rotation.

5 Claims, 4 Drawing Figures

VIBRATING TUBULAR SCREEN

BACKGROUND OF THE INVENTION

The present invention is directed to a rotary tubular screen which includes mechanism for imparting a vibratory action to the screen. The mechanism is so arranged that the vibratory action is applied to the screen only when the combined weight of the screen and material contained in the screen exceeds a preselected minimum weight, thus preventing the application of an excessive vibratory force to the screen. Because the vibratory force applied is most useful when a screen of this type is substantially full of material to be separated, application of the same vibratory force to the screen when the screen is substantially empty can cause an excessive vibratory motion of the screen.

In accordance with the present invention, the vibratory mechanism may consist of a simple flattened roller frictionally driven by the screen, but capable of contacting the screen only when a sufficient amount of material is contained in the screen to adequately absorb the vibratory forces applied.

SUMMARY OF THE INVENTION

In a tubular screen constructed in accordance with the present invention, the screen is constructed with a coaxial cylindrical support ring at a location intermediate the end of the screen. When the screen is empty, two support rollers on the machine frame engage the support ring to support the screen for rotation about its axis. One of the support rollers is mounted at a fixed location on the frame, while the other support roller is mounted on a spring biased bell crank pivotally supported on the machine frame so that this second support roller can deflect downwardly against the spring bias applied to the bell crank in response to the combined weight of the screen and material supported in the screen. A vibrating roller having a flattened portion on its circumference may be mounted on the bell crank pivot or some other location fixed relative to the frame where the circumference of the vibratory roller is frictionally contacted by the support ring when the weight of material in the screen is sufficient to deflect the movable support roller downwardly. The spring biasing action applied to the roller supporting bell crank is selected to be such that the screen remains out of contact with the vibratory roller until a predetermined weight of material is present within the screen.

Other objects and features of the invention will become apparent by reference to the following specification and to the drawings.

IN THE DRAWINGS

Figure 1:
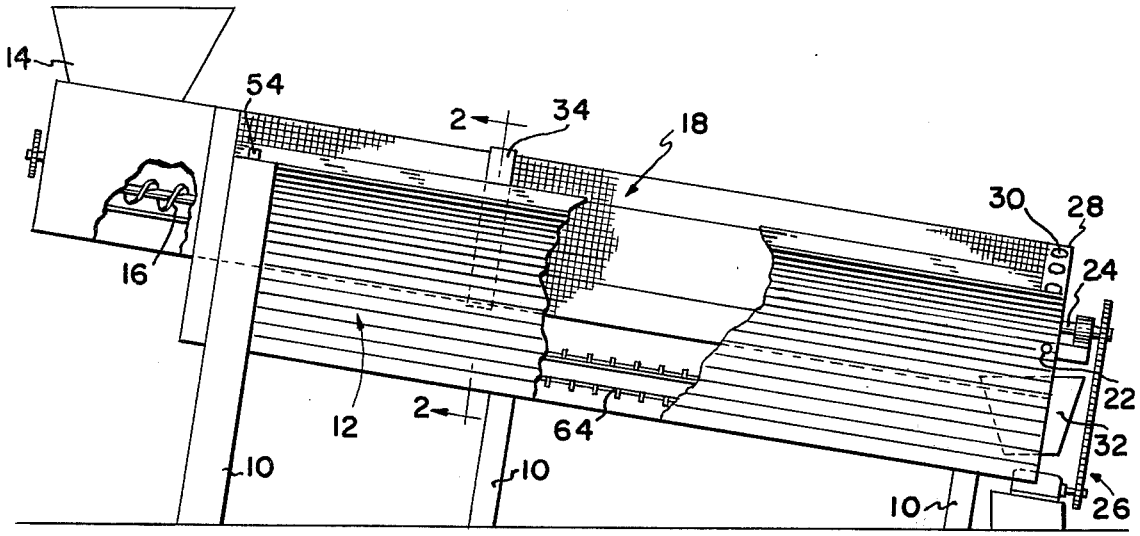
FIG. 1 is a side view, with certain parts broken away, of a vibratory screen embodying the present invention.

Apparatus embodying the invention includes a fixed frame assembly having posts 10 fixedly supporting an elongate inclined trough designated generally 12. At the upper or left-hand end of the apparatus as viewed in FIG. 1, a receiving hopper 14 having a pair of conveying screws 16 is mounted on the frame to receive material to be fed into the interior of an elongate tubular screen 18 mounted for rotation within trough 12.

At the lower, or right-hand end of the trough as viewed in FIG. 1, a bearing assembly 20 is pivotally mounted on the trough as at pivot 22 to rotatably support a shaft 24 coaxially secured to the end of screen 18 and driven in rotation by suitable drive means designated generally 26. The right-hand end of screen 18 is closed as by an end cap member 28 having a series of relatively large openings such as 30 of a size sufficient to discharge coarse particles which are collected and transferred by a suitable transverse trough 32.

Pivotal mounting of bearing 20 upon the transverse horizontal pivot 22 accommodates pivotal motion of screen 18 about the axis of pin 22 for reasons set forth below.

Figure 2:
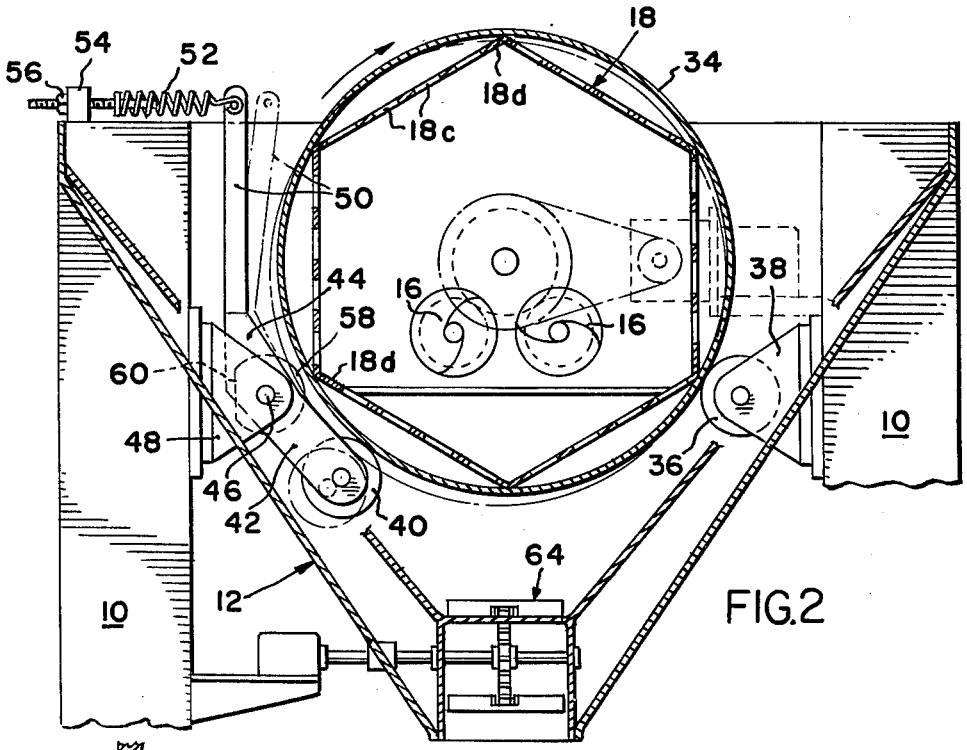
FIG. 2 is a cross sectional view of the apparatus of FIG. 1, taken on the line 2—2 of FIG. 1.

Referring now particularly to FIG. 2, it is seen that screen 18 is of hexagonal transverse cross section to assure a maximum mixing and tumbling action of wood chips passing through the screen. At a location approximately two-thirds of the length of screen 18 from the end supported on bearing 20, a cylindrical support ring 34 is fixedly and coaxially mounted upon the screen. Support ring 34 is supported upon a first support roller 36 mounted for rotation on the machine frame at a fixed location by a bracket 38. A second support roller 40 normally supportingly engages support ring 34. Roller 40 is mounted at the distal end of one arm 42 of a bell crank 44 which is pivotally mounted at pivot 46 upon a bracket 48 fixedly mounted upon the machine frame. The distal end of the remaining arm 50 of bell crank 44 is coupled by means of a tension spring 52 to the machine frame as at 54, this coupling preferably including an adjustment nut 56 for adjustably tensioning spring 52. Spring 52 biases bell crank 44 is counterclockwise direction about pivot 46, thus roller 40 is urged upwardly generally toward the rotational axis of screen 18.

A vibratory roller 58 having a flattened circumferential portion 60 is rotatably supported on the machine frame, conveniently upon pivot 46 of the bell crank. As best shown in the full line view of FIG. 2, the biasing action of spring 52 upon bell crank 44 normally is such that roller 40 is urged upwardly a distance sufficient to maintain support ring 34 completely clear of contact with vibratory roller 38. However, upon the filling of screen 18 with a predetermined weight of material to be separated, the increased combined weight of the material and screen becomes sufficient to depress roller 40 from the full line position of FIG. 2 to the broken line position, at which time support ring 34 moves into contact with vibratory roller 48. The frictional engagement between support ring 34 and roller 58 drives roller 58 in rotation as screen 18 is rotated and the periodic engagement between support ring 34 and the flattened cricumferential portion 60 of roller 58 imparts a radially directed vibratory force to screen 18. The upper or left-hand end of the screen as viewed in FIG. 1 is entirely open to receive material discharged by screws 16 from hopper 14, and this upper or left-hand end of screen 18 is supported only by the engagement between support ring 34 and rollers 36, 40, and 58. Thus, the upper or left-hand end of the screen as viewed in FIG. 1 is free to bounce in response to the vibratory action produced by its engagement with roller 58. The upper or left-hand end of the screen is also free to move upwardly or downwardly in accordance with the weight of material contained in screen 18, this latter movement being accommodated by the pivotal mounting 22 of the bearing supporting the lower or right-hand end of screen 18.

In operation, the size of the perforations or openings in screen 18 are selected in accordance with the size of particles desired to be separated. The machine disclosed in this application, although capable of use with other particulate material, was especially designed to separate wood chips into coarse and fine sized groupings, different end uses requiring chips within a specified size range.

In the case of a wood chip separating operation, the chips produced by a conventional chipping operation are normally divided or classified as classes A, B, C, and D. The most valuable chips are the class A chips which are typically employed in high grade pulp or paper mills, these chips being the largest size of the four classifications. The maximum chip dimensions are determined by the chipper components and its speed of operation, the smaller class B, C and D chips resulting from variations in feed rate, distance from the center of the chipper disc, knots, etc. Class A chips are not cubicle and normally have dimensions in which the width is greater than the thickness and the length is greater than the width, as for example a chip having nominal dimensions of ½ inch by one inch by two inches. A screen designed to retain chips having these last dimensions, while passing chips of smaller dimensions might typically have screen openings one inch square. Thus, while such a screen would retain chips of the foregoing dimensions lying flat against the screen surface, such a chip presented endwise to a screen opening could pass through the screen.

In order to minimize this latter possibility, in the polygonal cross section screen construction shown in the drawings screen openings are not formed in the leading end of each side of the screen, the term "leading end" being employed with respect to the direction of rotation of the screen.

Figure 3:
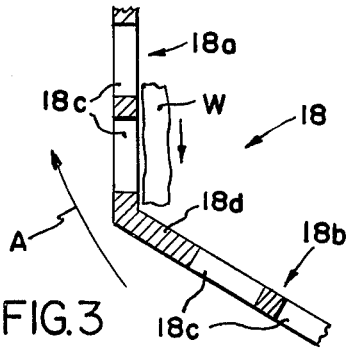
FIG. 3 is a detailed cross sectional view taken on the line 3—3 of FIG. 2.
Figure 4:
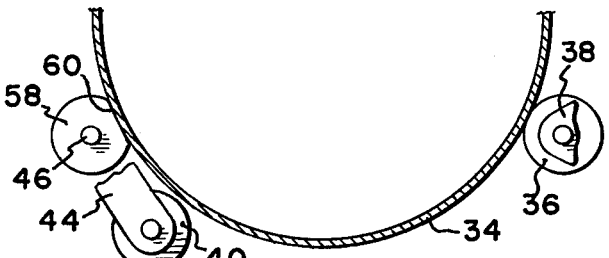
FIG. 4 is a partial cross sectional view, similar to FIG. 2, showing the movable support roller assembly in a different position.

Referring to FIG. 3, there is shown a partial cross sectional view of screen 18 adjacent the juncture of two sides of the screen **18*a* and 18*b*. As viewed in FIG. 3, screen 18 is being rotated in a clockwise direction as indicated by the arrow A. Neglecting, for the moment, the inclination of the axis of screen 18, during each revolution of the screen, each side successively passes through a generally horizontal position as it becomes the lowermost side of the rotating screen and then successively passes through the angle of inclination of side 18*b* of FIG. 3 and then moves into the vertical position assumed by side 18*a* of FIG. 3. When the particular screen side is in its horizontal position at the lowermost position of its rotary path, the tendency of chips within the screen is to lie flat against the then horizontal bottom. As the screen side passes through the bottom or lowermost portion of its path, further rotation of the screen causes the side to progressively tilt toward the vertical as it moves up toward the 9:00 o'clock position of its rotary path. During this movement, chips lying flat on the screen side tend to slide downhill toward the trailing end of the screen side, as represented by the wood chip W shown in FIG. 3. If a screen opening 18*c* were present in side 18*b* closely adjacent the juncture of sides 18*a* and 18*b*, it is believed apparent that there would be a possibility that the sliding wood chip W of FIG. 3 could pass endwise through such an opening. In order to minimize this possibility, the leading end of each side of screen 18 is formed with a solid or unperforated leading end section 18*d* to deflect a chip such as one in the path position of the chip W of FIG. 3 into flat sliding engagement with the inner surface of side 18*b* as the upwardly rotating side 18*b*** and the downwardly sliding wood chip W move past each other.

Apart from the solid or unperforated leading end sections 18d on each side of the polygonal screen, openings 18c are distributed uniformly over the entire screen surface.

Chips to be separated are fed into hopper 14 and are transferred from the hopper by screws 16 into the open upper end of the rotating screen 18. The hexagonal cross section of the rotating screen 18 subjects the chips to a continuous tumbling action, while the inclination of the axis of the screen, combined with the tumbling action, effectively conveys the chips to the right as viewed in FIG. 1 toward the lower end of screen 18. The substantial length of screen 18, combined with the tumbling action imparted by the hexagonal cross section screen causes chips of a size smaller than the screen openings to drop downwardly through the openings from the screen into the interior of trough 12 and a conveyor 64 mounted at the bottom of the trough conveys the separated finer chips upwardly to the left-hand end of the trough 12 where it may discharge the separated chips onto a suitable take-out conveyor, not shown. The coarser chips which do not pass downwardly through the screen eventually reach the lower right-hand end of the screen as viewed in FIG. 1 and are discharged from the interior of the screen through the enlarged openings 30 at this end into the take-out trough 32.

When the chips first begin to flow into the upper end of screen 18 upon the commencement of a separating operation, the biasing action of spring 52 causes roller 40 to support the rotating screen and its support ring out of contact with the flattened vibratory roller 46 because at the start-up, there is not a sufficient weight of material in the screen to depress roller 40 against spring 52. However, at this stage of operation, only a relatively small number of chips are in the screen and adequate separation can be achieved without the assistance of any vibratory action. However, as the mass of chips contained within screen 18 increases, finer particles may find it difficult to work their way through the increased mass of chips within the screen, and at this point the assistance of a vibratory action to the screen and chips contained in the screen is desired to increase the separating action. Movement of the screen into an operative vibratory contact between support ring 34 and vibratory roller 58 is accomplished in a self-regulating manner simply by applying the increased weight of the additional amount of chips in the screen to overcome the biasing action of spring 52 to permit the screen to sink on its mounting to a point where support ring 34 rolls into contact with vibratory roller 58. Thus, the vibratory action is applied only when there is a sufficient weight of material in the screen so that the vibratory force applied is adequately absorbed and excessive motion or bouncing of a partially filled screen is avoided.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

What is claimed is:

1. A vibratory screen for screening particulate material comprising a frame, an elongate tubular screen, first means on said frame supporting one end of said screen for rotation about its axis, second means on said frame cooperable with said first means to support said screen for rotation about its axis with said axis inclined to the horizontal, drive means for driving said screen in rotation about its axis, said second means engaging said screen at a location interjacent the ends thereof and including yieldable means deflectable in accordance with the weight of material in said screen, and vibratory means on said second means operable to impart a radially directed vibratory force to said screen when said yieldable means has been deflected by an amount representative of a predetermined weight of material in said screen.

2. The invention defined in claim 1 wherein said yieldable means comprises a screen support roller engaged in supporting relationship with said screen, lever means pivotally mounted on said frame mounting said support roller for movement relative to said frame in engagement with said screen, and spring means engaged between said frame and said lever means resiliently biasing said lever means in a direction urging said support roller upwardly against said screen.

3. The invention defined in claim 2 wherein said lever means comprises a bell crank member pivotally mounted on a first pivot on said frame, said support roller being mounted on the distal end of one arm of said bell crank and said spring means being coupled to the distal end of the other arm of said bell crank, and said vibratory means comprises a roller member having a flattened circumferential section rotatably mounted on said first pivot, said spring means biasing said bell crank to support said screen out of engagement with said roller member when said screen is empty.

4. A vibratory screen for screening particulate material comprising a frame, an elongate tubular screen of polygonal transverse cross section, first support means supporting one end of said screen for rotation about its axis, second support means including circular support ring fixedly mounted on said screen in coaxial relationship therewith intermediate the ends of said screen, roller support means mounted on said frame supportingly engaging said support ring, drive means for driving said screen in rotation about its axis, said roller support means including a first roller mounted for vertical movement relative to said frame and a vibrating means mounted at a fixed location in said frame, and biasing means biasing said first roller upwardly relative to said frame to a position wherein said first roller is operable to maintain said support ring out of engagement with said vibrating means when the combined weight of said screen and material therein is less than a predetermined weight.

5. The invention defined in claim 4 wherein said vibrating means comprises a non-circular member mounted for rotation about a fixed axis on said frame and engageable with said support ring when the combined weight of said screen and material therein exceeds said predetermined weight.

* * * * *